US008083325B2

(12) United States Patent
Inoue et al.

(10) Patent No.: US 8,083,325 B2
(45) Date of Patent: Dec. 27, 2011

(54) LIQUID EJECTION RECORDING HEAD HAVING ELEMENT SUBSTRATE WITH PLURAL SUPPLY PORTS

(75) Inventors: Tomoyuki Inoue, Tokyo (JP); Ken Tsuchii, Sagamihara (JP); Masataka Sakurai, Kawasaki (JP); Akiko Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 363 days.

(21) Appl. No.: 12/389,981

(22) Filed: Feb. 20, 2009

(65) Prior Publication Data

US 2009/0231394 A1 Sep. 17, 2009

(30) Foreign Application Priority Data

Feb. 22, 2008 (JP) ..... 2008-041432

(51) Int. Cl.
*B41J 2/05* (2006.01)

(52) U.S. Cl. ..... 347/65; 347/63; 347/56

(58) Field of Classification Search ..... 347/17, 347/18, 20, 44, 47, 56, 61–65, 67, 92–94
See application file for complete search history.

(56) References Cited

U.S. PATENT DOCUMENTS

| | | | | |
|---|---|---|---|---|
| 6,286,933 | B1 | 9/2001 | Murakami et al. | |
| 6,540,335 | B2 | 4/2003 | Touge et al. | |
| 6,557,983 | B1 | 5/2003 | Inoue | |
| 6,719,408 | B2 * | 4/2004 | Yoshihira et al. | 347/65 |
| 2003/0058308 | A1 | 3/2003 | Yamamoto | |
| 2003/0071865 | A1 | 4/2003 | Mott et al. | |
| 2008/0136872 | A1 | 6/2008 | Tsuchii et al. | |
| 2009/0040273 | A1 | 2/2009 | Tsuchii et al. | |
| 2009/0066752 | A1 | 3/2009 | Ide et al. | |
| 2009/0179939 | A1 | 7/2009 | Ide et al. | |

FOREIGN PATENT DOCUMENTS

| | | |
|---|---|---|
| JP | 2003-118124 | 4/2003 |
| JP | 2003-170597 | 6/2003 |

* cited by examiner

*Primary Examiner* — Juanita D Stephens
(74) *Attorney, Agent, or Firm* — Fitzpatrick, Cella, Harper & Scinto

(57) ABSTRACT

A liquid ejection recording head includes an element substrate having plural ejection energy generating elements, an ejection outlet array of plural ejection outlets, and bubble generation chambers. The element substrate includes a first liquid supply port provided along an arrangement direction of the ejection outlets, and plural second ink supply ports disposed between a lateral end of the substrate and the chambers. Each bubble generation chamber communicates with the first and second liquid supply ports through first and second liquid supply passages, respectively. The element substrate has a thermal resistance against heat flowing from the ejection energy generating elements along a direction perpendicular to the array direction and parallel to a surface of the substrate. The thermal resistance, per unit length with respect to the array direction, at both end portions of the array is larger than that at a central portion of the ejection outlet array.

10 Claims, 11 Drawing Sheets

LIQUID EJECTION RECORDING HEAD HAVING ELEMENT SUBSTRATE WITH PLURAL SUPPLY PORTS

FIELD OF THE INVENTION AND RELATED ART

The present invention relates to a liquid ejection recording head for ejecting ink onto a recording material such as recording paper (sheet) to make recording and particularly relates to a structure of an element substrate provided with ejection energy generating elements.

A recording apparatus such as a printer, a copying machine, or a facsimile machine is constituted so as to record an image in a dot pattern on the recording material such as paper or plastic sheet, on the basis of image information. This recording apparatus can be classified into those of an ink jet type, a wire dot type, a thermal type, a laser beam type, and the like, depending on a recording method. Of these types of the recording apparatuses, the ink jet recording apparatus of the ink jet type is constituted so that an ink droplet is ejected from an ejection outlet of a nozzle of a recording head and is deposited on the recording material.

In recent years, the recording apparatus is required for high-speed recording, high resolution, high image quality, low noise, and the like. As the recording apparatus which meets such requirements, there is the ink jet recording apparatus.

In the ink jet recording apparatus, as one of means for realizing high-speed recording, improvement in ejection frequency of the liquid ejection recording head may be made and a nozzle structure of the liquid ejection recording head for improving the ejection frequency has been conventionally proposed. An upper limit of the ejection frequency of the liquid ejection recording head is a time from supply of ink into a nozzle after ink ejection to filling of the nozzle with the ink (hereinafter referred to as a "refilling time"). With a short refilling time, it is possible to make recording at a higher ejection frequency.

As shown in FIGS. 9A and 9B, in the case of a conventional nozzle structure in which the ink is supplied from a single ink flow passage 107 into a bubble generation chamber 105, the refilling time is roughly determined by flow resistance of the ink flow passage portion. For this reason, the nozzle structure was subjected to constraints on the refilling time since a width of the ink flow passage was more narrowed with a smaller pitch for higher resolution.

In view of this, as shown in FIGS. 10A and 10B, such a nozzle structure that a bubble generation chamber 105 is provided corresponding to a single heater 101 and is supplied with the ink from two directions (from an ink flow passage 108 and an ink flow passage 109) has been proposed. It is considered that this nozzle structure is effective in compatibly realizing the high resolution of the nozzle and reduction in refilling time. That is, in the nozzle structure, the refilling time can be shortened by supplying the ink from the two directions into the bubble generation chamber 105.

In the conventional nozzle structure as shown in FIGS. 9A and 9B, a flow passage constituent member 116 as a wall for the flow passage is asymmetrical with respect to a Y-axis direction of the heater 101. That is, the flow passage constituent member 116 gives axial symmetry with respect to an X-axis but does not give the axial symmetry with respect to the Y-axis. For this reason, an ejection direction was not stably perpendicular to a plane of the heater 101 in some cases. On the other hand, in the nozzle structure shown in FIGS. 10A and 10B, the flow passage constituent member 116 is symmetrical with respect to both of the X-axis direction and the Y-axis direction. That is, the flow passage constituent member 116 gives the axial symmetry with respect to both of the X-axis and the Y-axis. For this reason, the ink can be stably ejected in a direction perpendicular to the plane of the heater 101.

Further, it has been considered that a method for improving the resolution by decreasing a volume of the ink to be ejected and narrowing an arrangement interval of ejection outlets is particularly effective as a constitution for obtaining a recording image with high definition and high gradation level. In the ink jet recording apparatus, particularly, ejection outlets for ejecting ink droplets having a stable volume to be deposited on the recording material with high accuracy and a high response frequency of the liquid ejection recording head are required. For this reason, in the ink jet recording apparatus, various improvements on an apparatus main assembly side such as multi-path and driving pulse control have been carried out but stabilization of an ink ejection amount largely depends on a performance of the liquid ejection recording head alone. That is, the stabilization of the ink ejection amount depends on slight errors occurring in a manufacturing step such as an ejection outlet shape of the liquid ejection recording head and variation of ejection energy generating elements (heaters) and, in addition, a temperature in the neighborhood of the ejection outlet affects the ink ejection amount and an ink ejection direction. When there was a local temperature distribution with respect to the ejection outlet array direction, the temperature distribution finally affected an image quality as density non-uniformity of the image to be formed. Particularly, in the thermal ink jet method in which the ink is ejected by utilizing thermal energy, it has been known that there is a tendency that the ink ejection amount and an ink ejection speed are increased by a change in bubble generation state or fluid property of the ink due to a temperature rise of the recording head. In order to suppress the influence of the temperature rise of the recording head on the image, such a technique that a heat conduction layer is introduced into a recording head substrate and is connected to a heat dissipation portion to suppress entire temperature rise has been proposed (Japanese Laid-Open Patent Application (JP-A) 2003-170597. Further, a technique for achieving an effect of cooling a recording head substrate itself by flow of ink supplied to a recording head has also been disclosed (JP-A 2003-118124).

In the conventional nozzle structures, a single elongated ink supply port is opened and provided along an arrangement direction of the heaters, i.e., along the ejection outlet array, so that heat is liable to diffuse at both end portions of the ejection outlet array since both ejection outlets are close to a non-heat generation area (e.g., logic wiring area) of the recording head substrate. For this reason, a difference in degree of temperature rise during drive of the heaters 101 is liable to occur between at both end portions of the ejection outlet array at which the heat is relatively liable to conduct from the heaters 101 to a recording head substrate 110 and at a central portion of the ejection outlet array at which the heat is relatively less liable to conduct from the heaters 101 to the recording head substrate 110.

This is true for the case of the nozzle structure which can compatibly realize the high-density nozzle arrangement and the ejection stability, i.e., the case of such a nozzle structure that two ink flow passages 108 and 109 for supplying the ink from the two directions to the single (one) bubble generation chamber 105. In this constitution, the ink flow passage 108 through which the ink is directly supplied from a common ink supply port 102 to the bubble generation chamber 105 and the ink flow passage 109 through which the ink is supplied via an opposite side from the ink flow passage 108 with respect to the ejection outlet array are as shown in FIG. 11.

SUMMARY OF THE INVENTION

A principal object of the present invention is to provide a liquid ejection recording head capable of stabilizing a recording quality by suppressing a temperature distribution with respect to an ejection outlet array direction at a low level to uniformize an ejection property of each of nozzles as much as possible.

In an aspect of the present invention, there is provided a liquid ejection recording head comprising:

an element substrate provided with a plurality of ejection energy generating elements for generating energy for ejecting ink;

an ejection outlet array comprising a plurality of ejection outlets for ejecting the ink; and bubble generation chambers for generating bubbles by the ejection energy generating elements, wherein the element substrate comprises a first ink supply port provided, by being penetrated through the element substrate, along an arrangement direction of the ejection outlets and comprises a plurality of second ink supply ports disposed between a lateral end of the element substrate and the bubble generation chambers, wherein each of the bubble generation chambers communicates with the first ink supply port through a first ink supply passage and communicates with the second ink supply ports through a second ink supply passage, and wherein the element substrate has a thermal resistance against heat flowing from the ejection energy generating elements along a direction which is perpendicular to an ejection outlet array direction and which is in parallel to a surface of the element substrate on which the ejection energy generating elements are formed, and wherein the thermal resistance, per unit length with respect to the ejection outlet array direction, at both end portions of the ejection outlet array is larger than that at a central portion of the ejection outlet array.

According to the present invention, a heat conduction (transfer) resistance from the ejection energy generating element to the element substrate is made different between at the central portion of the ejection outlet array and at both end portions of the ejection outlet array, so that the temperature distribution with respect to the ejection outlet array direction can be suppressed at a low level to eliminate a difference in ejection property among the respective nozzles, thus stabilizing the recording quality.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, specific embodiments of the present invention will be described with reference to the drawings.

First Embodiment

Figure 1C:
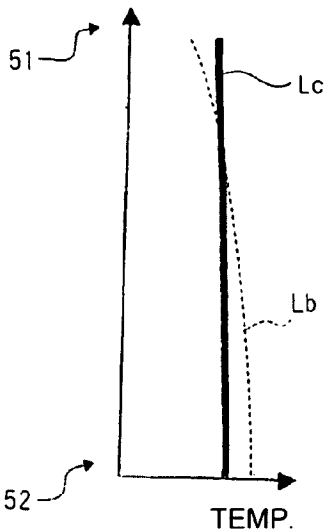
FIGS. 1A to 1C are schematic views for illustrating a recording head in First Embodiment.
Figure 1B:
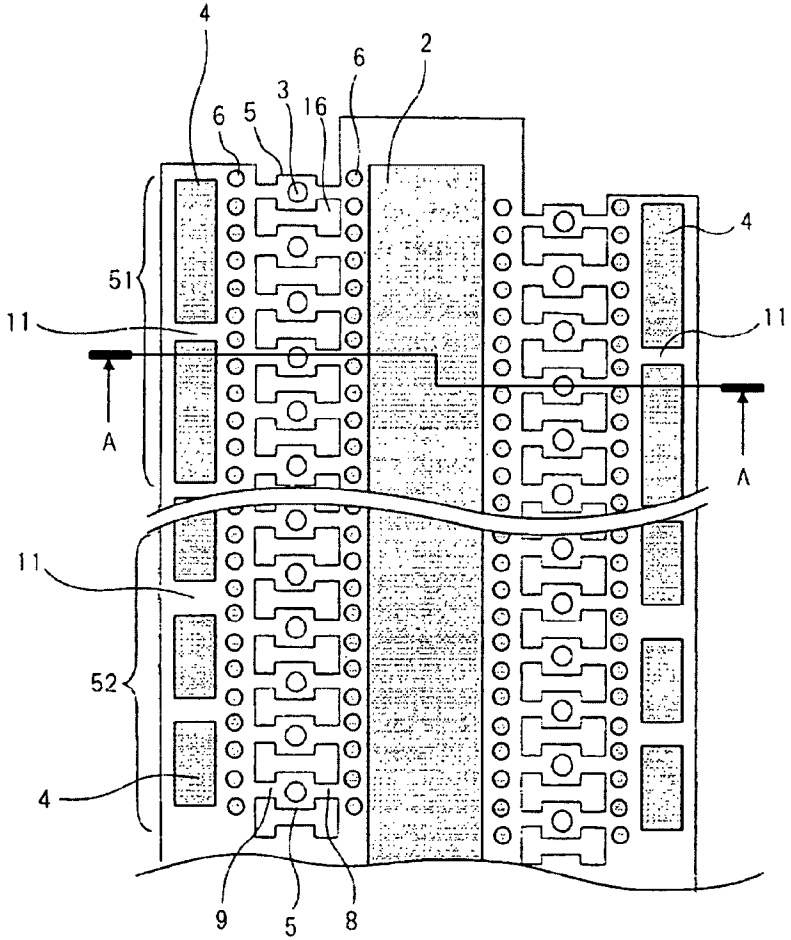
Figure 1A:
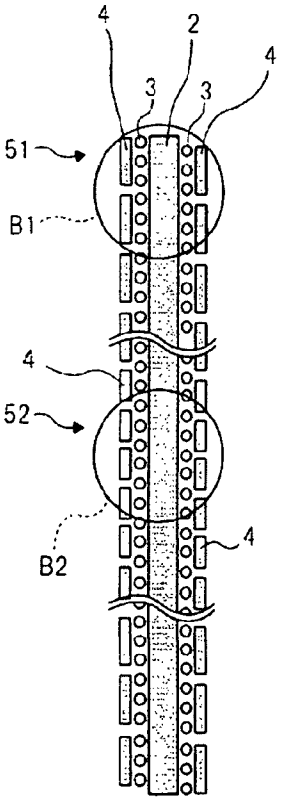
Figure 2:
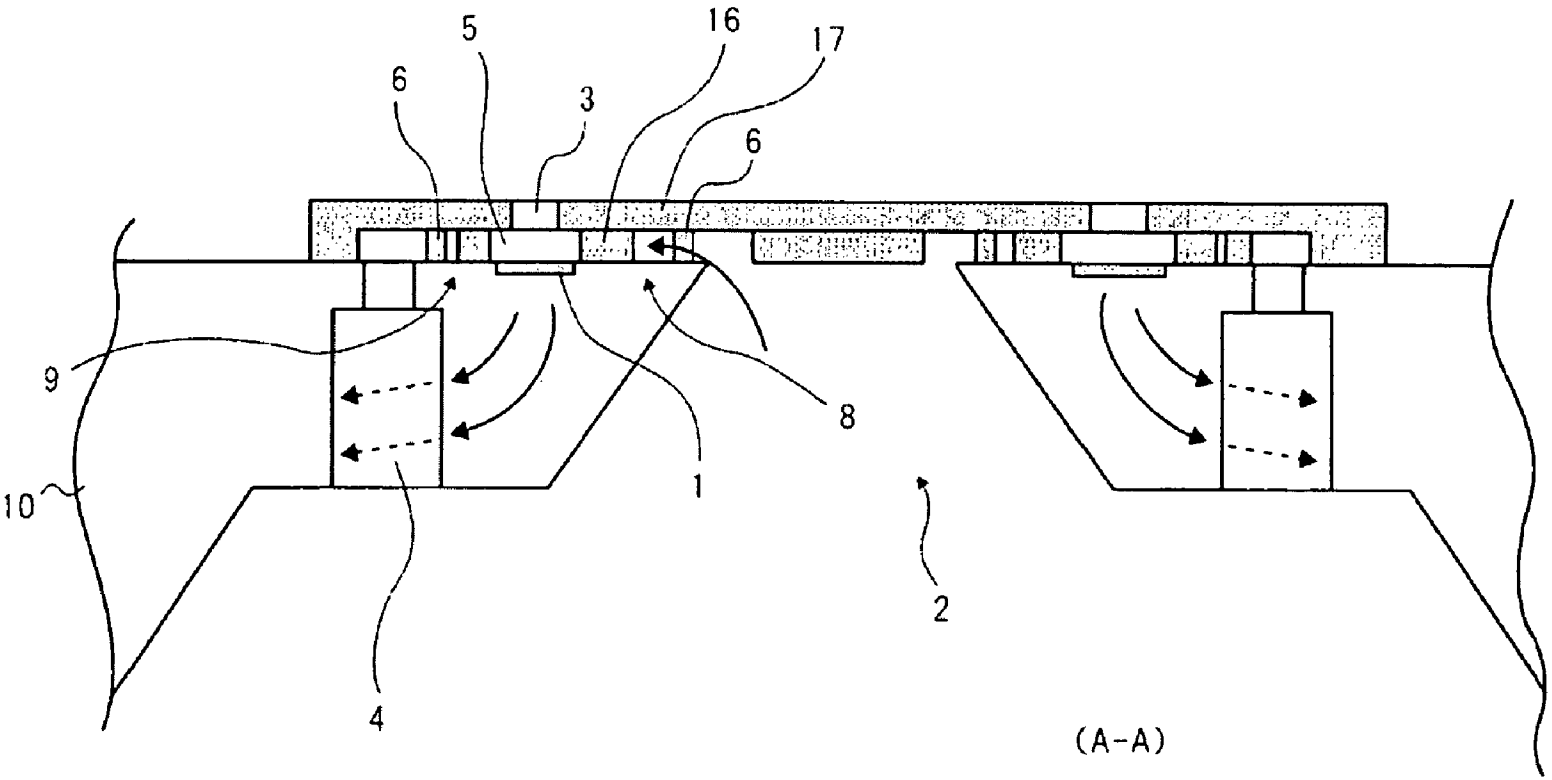
FIG. 2 is a sectional view for schematically illustrating the recording head in First Embodiment.
Figure 3:
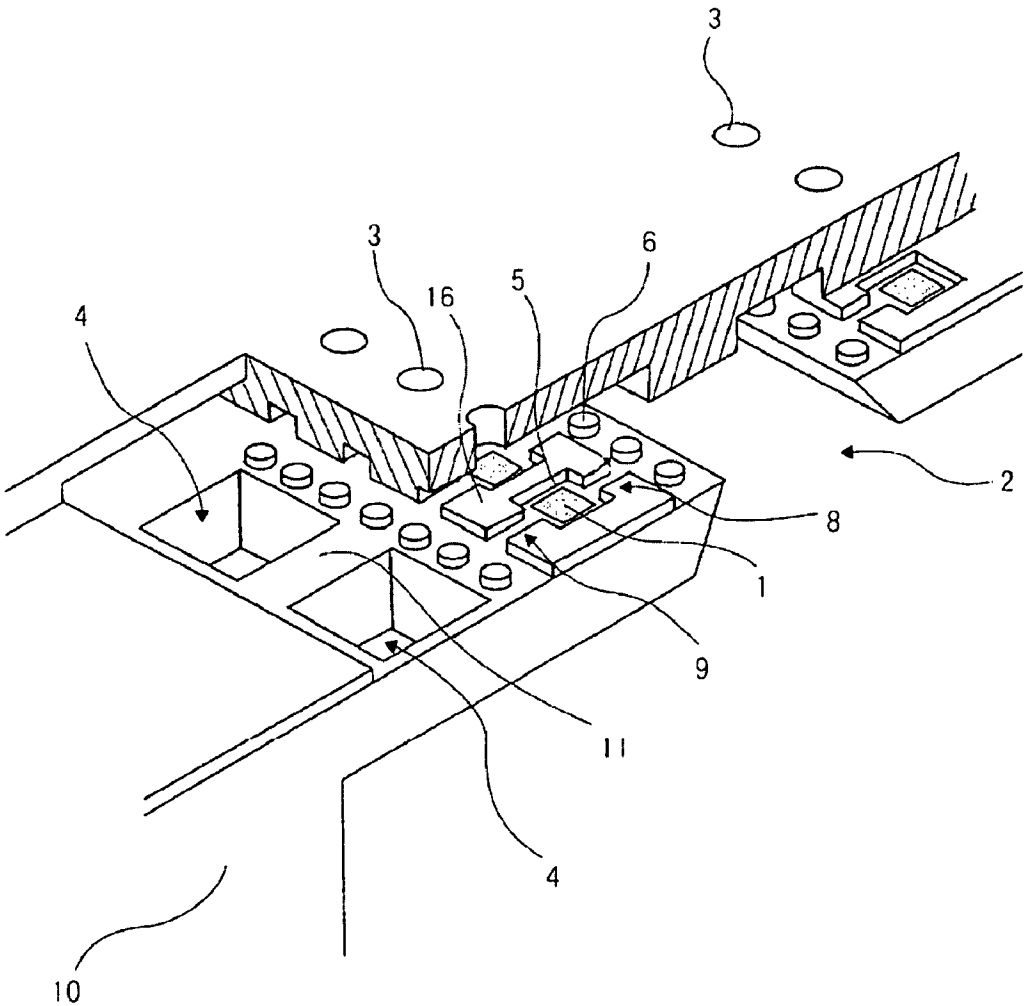
FIG. 3 is a partially broken schematic perspective view showing the recording head in First Embodiment.

FIGS. 1A to 1C are schematic views for illustrating a liquid ejection recording head in this embodiment, FIG. 2 is a sectional view taken along A-A line indicated in FIG. 1B, and FIG. 3 is a partially broken schematic perspective view showing the liquid ejection recording head. Further, FIG. 1B is an enlarged plan view showing portions B1 and B2 shown in FIG. 1A and FIG. 1C is a schematic diagram (graph) showing a temperature distribution in the neighborhood of the ejection outlets with respect to an ejection outlet array direction (nozzle array direction).

On a surface of a recording head substrate (Si wafer) 10 as an element substrate, a plurality of heaters 1 as electrothermal transducer elements as ejection energy generating elements for generating energy for ejection ink, unshown wiring for driving the heaters 1, and the like are disposed. As shown in FIGS. 1A, 1B and 2, the recording head substrate 10 includes the plurality of heaters 1, a common ink supply port 2 as a first ink supply port provided along an arrangement direction of these heaters 1, and a plurality of independent ink supply ports 4 which are independently used as a second ink supply port.

The common ink supply port 2 extending in a longitudinal direction of the recording head substrate 10 is an opening as a through hole provided in an elongated rectangular shape by being penetrated through the recording head substrate 10. Similarly, each of the independent ink supply ports 4 is an opening as a through hole provided by being penetrated through the recording head substrate 10 so as to communicate with the common ink supply port 2. The independent ink supply ports 4 are disposed between a lateral end of the recording head substrate 10 extending in parallel to the ejection outlet array direction and bubble generation chambers 5 in which bubbles are generated.

The heaters 1 are arranged in an array on each of both sides of the common ink supply port 2 with a pitch of 600 dpi with respect to a longitudinal direction of the common ink supply port 2. Further, on the surface of the recording head substrate 10, a flow passage constituent member 16 is provided and thereon an ejection outlet plate 17 is integrally molded with the flow passage constituent member 16. The flow passage constituent member 16 is provided with a plurality of ink flow passages 8 each as a first ink supply passage for guiding the ink, supplied from the common ink supply port 2, to an associated bubble generation chamber 5 on an associated heater 1 and is provided with a plurality of ink flow passages 9 each as a second ink supply passage for guiding the ink, supplied from the independent ink supply ports 4, to an associated bubble generation chamber 5 on an associated heater 1. The ink flow passages 8 and the ink flow passages 9 are formed so that associated two ink flow passages 8 and 9 communicate with an associated bubble generation chamber 5 from different two directions. The ejection outlet plate 17 is provided with ink ejection nozzles each formed so as to establish communication of an associated bubble generation chamber 5 partitioned by the flow passage constituent member 16 with the outside of the liquid ejection recording head. An ejection outlet 3 for ejecting ink droplets is constituted by an opening as an end of the ink ejection nozzle exposed at the surface of the ejection outlet plate 17.

The independent ink supply ports 4 are, as shown in FIGS. 1A and 1B, provided along the ejection outlet array direction and are different in opening shape between at an ejection outlet array end portion 51 and at a portion, other than both end portions 51 of the ejection outlet array, such as an ejection outlet array central portion. Between adjacent independent ink supply ports 4, a bridging portion 11 for separating the adjacent independent ink supply ports 4 extends in a direction perpendicular to the ejection outlet array direction. At the bridging portion 11, electric wiring or the like for driving the heaters 1 is disposed. Incidentally, with respect to a thickness direction of the recording head substrate 10, a depth of the opening of each of the independent ink supply ports 4 and a thickness of each of the bridging portions are about 100 μm and are substantially constant along the ejection outlet array direction.

In this embodiment, of an entire length (0.43 inch) of the ejection outlet array, at both end portions 51 of the ejection outlet array each in an area of about 20% (0.082 inch) from an end of the ejection outlet array, each of the independent ink supply ports 4 is formed in a rectangular opening shape of 30 μm×100 μm and is arranged at an interval corresponding to 200 dpi (pitch=about 126 μm). Further, at a portion other than the both end portions of the ejection outlet array, i.e., at the central portion of the ejection outlet array, each of the independent ink supply ports 4 is formed in a rectangular opening shape of 30 μm×60 μm and is arranged at an interval corresponding to 300 dpi (pitch=about 84 μm).

By employing the constitution in which the independent ink supply ports 4 are arranged in the above-described manner, an arrangement interval of the bridging portions 11, between adjacent independent ink supply ports 4, which are liable to conduct heat, i.e., a width of the bridging portions 11 with respect to the ejection outlet array is different between at the central portion and at both end portions. In this embodiment, the width of the bridging portions 11 at the central portion of the ejection outlet array is larger than that at the both end portions of the ejection outlet array. For this reason, a thermal resistance, per unit length with respect to the ejection outlet array direction, with respect to heat flowing from each heater 1 toward the recording head substrate 10 along a direction which is perpendicular to the ejection outlet array direction and which is in parallel to the surface of the recording head substrate 10 on which the heaters 1 are formed is larger at both end portions 51 of the ejection outlet array than at the central portion 52 of the ejection outlet array. Therefore, when the heat is conducted from the heaters 1 to the recording head substrate 10, heat transfer is similarly performed at the ejection outlet array central portion 52 and the ejection outlet array both end portions 51, so that the difference in temperature distribution in the ejection outlet array can be decreased.

Figure 7C:
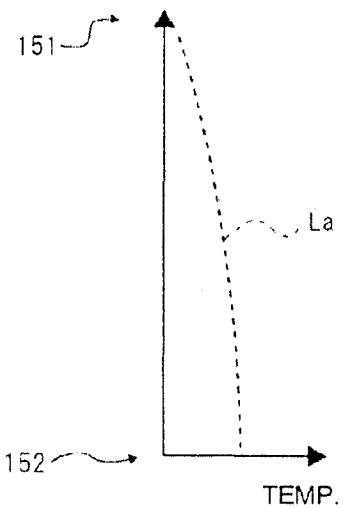
Fig. 7C PRIOR ART
FIGS. 7A to 7C are schematic views for illustrating a conventional recording head provided with no independent ink supply port.
Figure 7B:
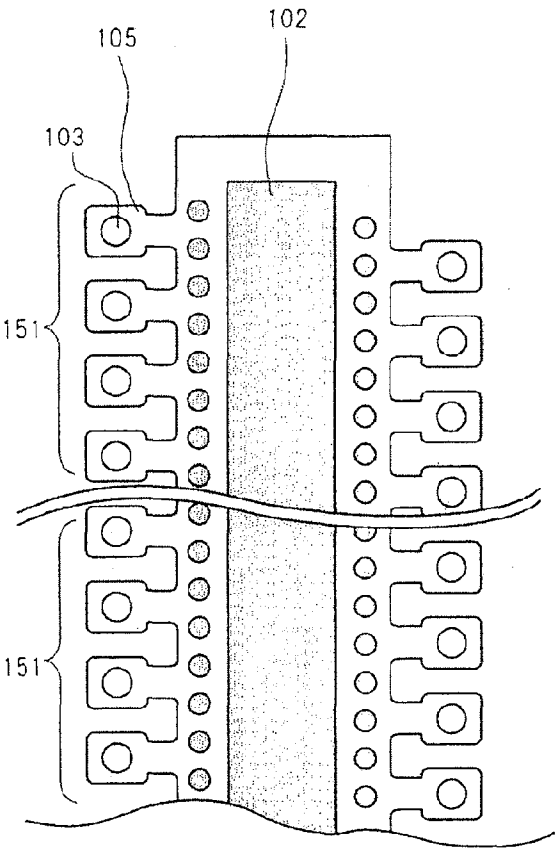
Fig. 7B PRIOR ART
Figure 7A:
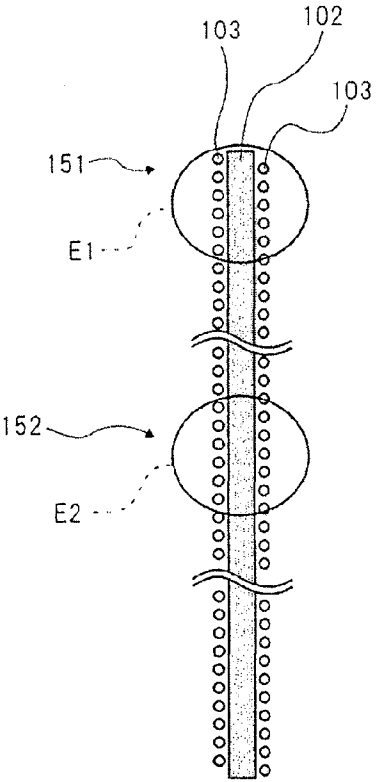
Fig. 7A PRIOR ART
Figure 8:
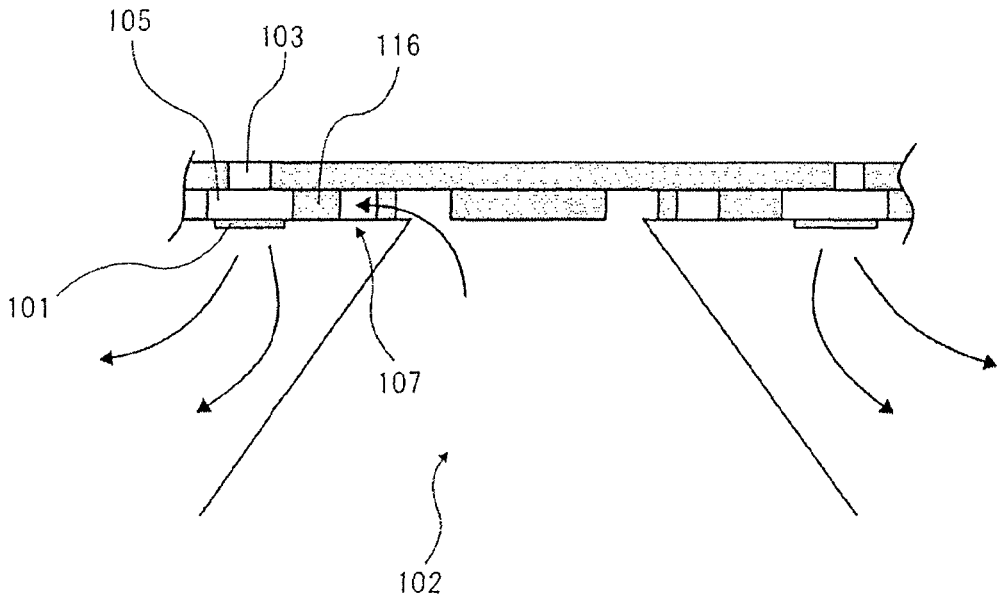
Fig. 8 PRIOR ART
FIG. 8 is a sectional view of the conventional recording head shown in FIGS. 7A and 7B.
Figure 9B:
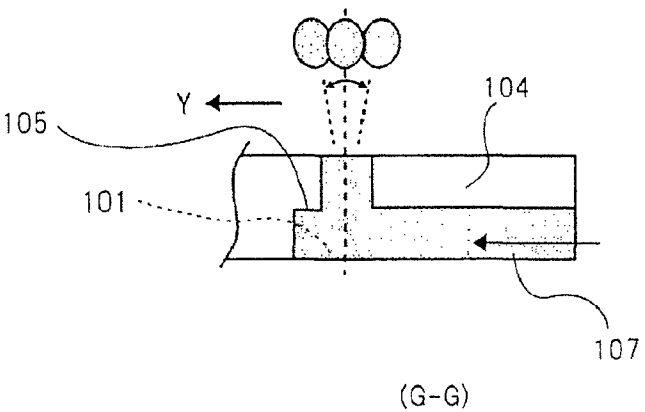
Fig. 9B PRIOR ART
FIGS. 9A and 9B are schematic views showing a flow passage constitution for supplying ink from only one direction to a single bubble generation chamber.
Figure 9A:
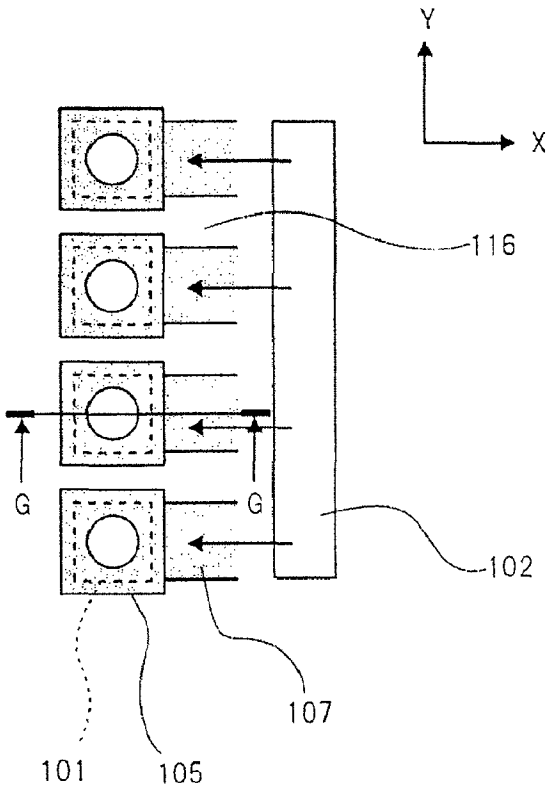
Fig. 9A PRIOR ART
Figure 10B:
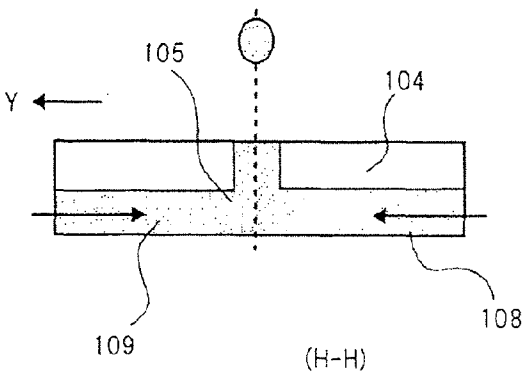
Fig. 10B PRIOR ART
FIGS. 10A and 10B are schematic views showing a flow passage constitution for supplying ink from two directions to a single bubble generation chamber.
Figure 10A:
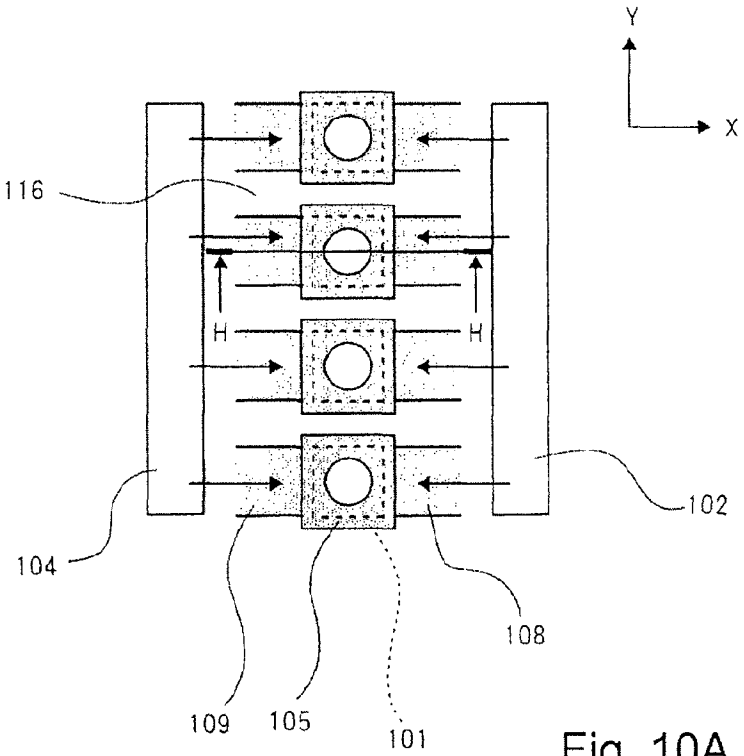
Fig. 10A PRIOR ART
Figure 11:
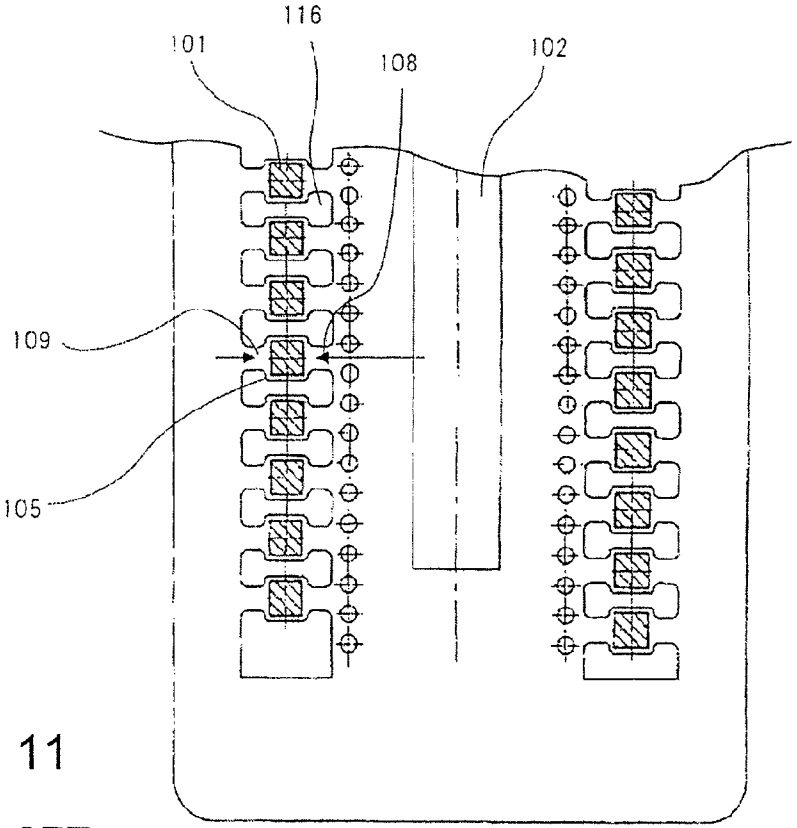
Fig. 11 PRIOR ART
FIG. 11 is a plan view of a conventional recording head in which the ink is supplied from the two directions to the single bubble generation chamber.

As a comparative embodiment, a constitution of a recording head substrate provided with no independent ink supply port is shown in FIGS. 7A to 7C and FIG. 8. FIGS. 7A to 7C are schematic views for illustrating the recording head substrate, wherein FIG. 7B is an enlarged view of portions E1 and E2 shown in FIG. 7A. FIG. 8 is a sectional view of the recording head substrate.

When a temperature distribution at the ejection outlet array both end portions and at the ejection outlet array central portion was measured by actually driving the recording head substrate of this comparative embodiment, the result shown in FIG. 7C was obtained. FIG. 7C is a schematic diagram showing the temperature distribution in the neighborhood of the ejection outlets with respect to the ejection outlet array direction. The temperature distribution was measured immediately after high-duty continuous ejection corresponding to full 5 sheets of A4-sized paper was performed. In the case where the constitution of the recording head substrate provided with no independent ink supply port as shown in FIGS. 7A, 7B and 8, a temperature difference of about 4° C. is caused between at the ejection outlet array central portion and at the ejection outlet array both end portions.

Therefore, in this case, the temperature distribution with respect to the ejection outlet array direction is relatively large. However, compared with this constitution of the recording head substrate provided with no independent ink supply port, a constitution of a recording head substrate provided with independent ink supply ports each having an identical opening shape and an identical arrangement interval tends to provide a somewhat large temperature distribution of the entire recording head.

Compared with these constitutions, in the case where the constitution of this embodiment is applied as shown in FIGS. 1A to 1C and FIG. 2, the temperature difference between at the ejection outlet array both end portions and at the ejection outlet array central portion is suppressed to about 1.5° C., thus resulting in a relatively small temperature distribution as compared with the constitution in which the independent ink supply ports are arranged in the identical opening shape and at the identical interval (pitch) with respect to the ejection outlet array direction.

Generally, in the case where the ink ejection amount is changed with temperature rise, it has been known that the change adversely affects an imaging performance. In the case where the temperature difference of about 4° C. as in the above-described conventional constitution, the ink ejection amount at the ejection outlet array central portion is larger than that at the ejection outlet array both end portions by about 5%. As a result, a density non-uniformity such that a recording pattern formed at the ejection outlet array central portion is relatively dark and a recording pattern formed at the ejection outlet array both end portions is relatively light is liable to occur.

With respect to such a phenomenon, it is possible to suppress the difference in ink ejection amount to about 2% by suppressing the temperature difference with respect to the ejection outlet array direction to about 1.5° C. as in this embodiment (First Embodiment).

Figure 4:
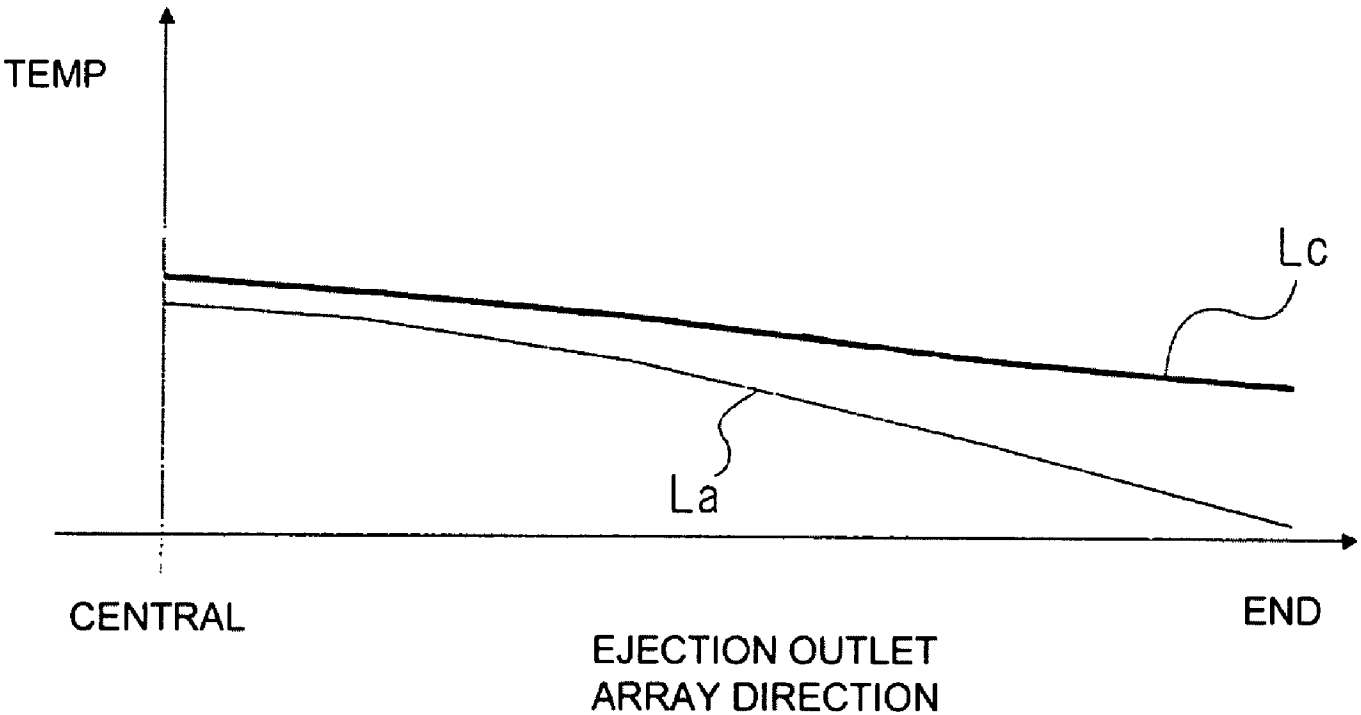
FIG. 4 is a graph showing a temperature distribution with respect to an ejection outlet array direction.

FIG. 4 is a graph showing temperature distributions with respect to the ejection outlet array direction in the above-described conventional (comparative) constitution and the constitution of this embodiment. As shown in FIG. 4, the temperature distribution of the conventional constitution provided with no independent ink supply port is represented by a curve La, which shows a relatively large temperature difference between at the central portion of the ejection outlet array and at the end portion of the ejection outlet array. That is, the temperature at the ejection outlet array central portion is higher and the temperature at the ejection outlet array both end portions is lower. In the case where the independent ink supply ports are arranged in the identical opening shape and at the identical arrangement interval (pitch), the temperature distribution is represented by a curve Lb (FIG. 1C), which shows a large temperature difference between at the central portion of the ejection outlet array and at the end portion of the ejection outlet array similarly as in the curve La. That is, the temperature at the ejection outlet array central portion is higher and the temperature at the ejection outlet array both end portions is lower. Further, in this case, the openings of the independent ink supply ports restrict a heat transfer path from the heaters to the recording head substrate, so that the temperature is somewhat higher as a whole. Compared with the above constitutions, in the case of the constitution of this embodiment, thermal (heat) resistance in an area of the ejection outlet array central portion which is originally liable to be placed in a high temperature state is small and that in an area of the ejection outlet array both end portions which is relatively less liable to be placed in the high temperature state is large. For this reason, in the case of the constitution of this embodiment, as shown in FIGS. 1C and 4 by a curve Lc, the temperature difference between at the ejection outlet array central portion area and at the ejection outlet array both end portion area can be suppressed at a low level, so that uniformity of the temperature distribution with respect to the ejection outlet array direction can be improved. Therefore, according to this embodiment, an ejection property of each of the nozzles can be uniformized and darkness non-uniformity occurring in the ejection outlet array direction can be suppressed, so that it is possible to stabilize a recording quality.

Second Embodiment

Figure 5B:
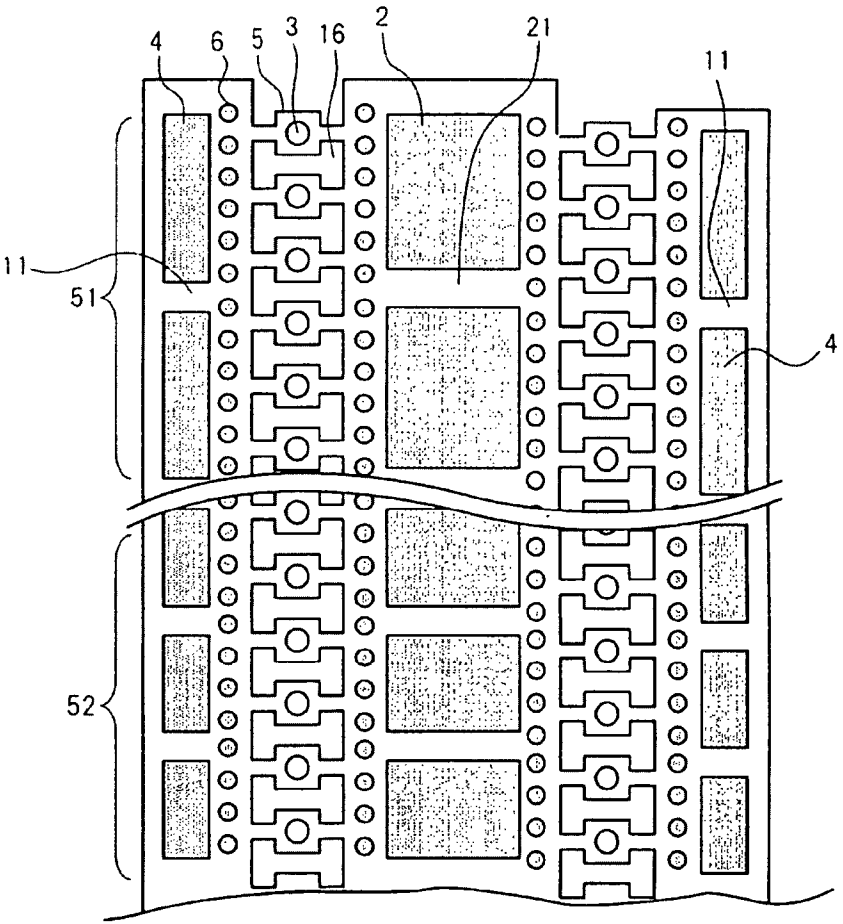
FIGS. 5A and 5B are schematic views for illustrating a recording head in Second Embodiment.
Figure 5A:
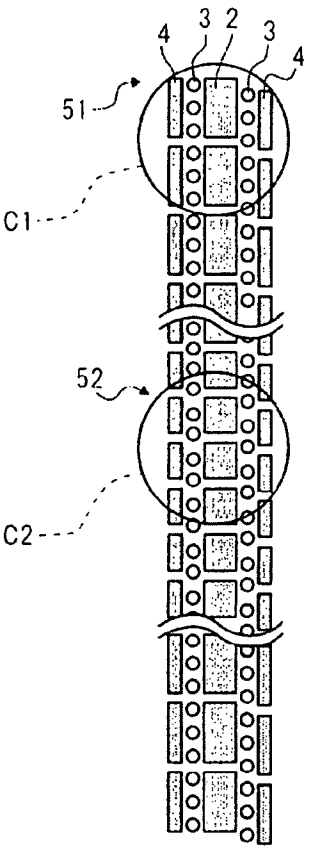

Second Embodiment of the present invention will be described with reference to FIGS. 5A and 5B by principally explaining a difference in constitution from First Embodiment. FIGS. 5A and 5B are schematic views of a recording head in this embodiment, wherein FIG. 5B is an enlarged view of portions C1 and C2. A basic constitution of this embodiment is similar to that of First Embodiment and therefore members or portions for the constitution of this embodiment are represented by reference numerals identical to those in First Embodiment and are omitted from detailed description.

The independent ink supply ports 4 in this embodiment are, as shown in FIGS. 5A and 5B, provided along the ejection outlet array direction and are different in opening shape between at an ejection outlet array end portion 51 and at a portion, other than both end portions 51 of the ejection outlet array, such as an ejection outlet array central portion.

Further, in this embodiment, a plurality of common ink supply ports 2 is separated by a plurality of bridging portions 21 each provided to extend in a direction perpendicular to the ejection outlet array direction.

At the bridging portion 11 separating adjacent independent ink supply ports 4, electric wiring or the like for driving the heaters 1 is disposed. Incidentally, with respect to a thickness direction of the recording head substrate 10, a depth of the opening of each of the independent ink supply ports 4 and a thickness of each of the bridging portions are about 100 μm and are substantially constant along the ejection outlet array direction.

With respect to intervals of the independent ink supply ports 4 and the common ink supply ports 2, similarly as in First Embodiment, of an entire length (0.43 inch) of the ejection outlet array, at both end portions 51 of the ejection outlet array each in an area of about 20% (0.082 inch) from an end of the ejection outlet array, each of the independent ink supply ports 4 and each of the common ink supply ports 2 are formed at an interval corresponding to 200 dpi (pitch=about 126 μm). Further, at a portion other than the both end portions of the ejection outlet array, i.e., at the central portion of the ejection outlet array, each of the independent ink supply ports 4 and each of the common ink supply ports 2 are formed an interval corresponding to 300 dpi (pitch=about 84 μm).

Each of the independent ink supply ports 4 is formed in a rectangular opening shape of 30 μm×100 μm at the ejection outlet array both end portions 51 and is formed in a rectangular opening shape of 30 μm×60 μm at the ejection outlet array central portion 52.

Each of the common ink supply ports 2 is formed in a rectangular opening shape of 90 μm×100 μm at the ejection outlet array both end portions 51 and is formed in a rectangular opening shape of 90 μm×60 μm at the ejection outlet array central portion 52.

By employing such a constitution, an arrangement interval of the bridging portions 11, between adjacent independent ink supply ports 4, which are liable to conduct heat is different between at the central portion and at the both end portions. For this reason, a thermal resistance per unit length with respect to the ejection outlet array direction for heat conduction in a direction from each heater 1 toward the recording head substrate 10 is larger at the both end portions 51 of the ejection outlet array than at the central portion 52 of the ejection outlet array.

When the temperature distribution at the ejection outlet array both end portions and at the ejection outlet array central portion was measured by actually driving the recording head substrate in this embodiment, a result similar to that in First Embodiment was obtained. In a comparison immediately after high-duty continuous ejection corresponding to full 5 sheets of A4-sized paper, in the case where the constitution of this embodiment was applied, the temperature difference between at the ejection outlet array both end portions and at the ejection outlet array central portion was suppressed to about 1.5° C.

According to this embodiment, the heat transfer (conduction) path from the heaters 1 to the recording head substrate 10 is made different between at the ejection outlet array central portion 52 and at the ejection outlet array both end portions 51, so that the temperature distribution with respect to the ejection outlet array direction is uniformized similarly as in Embodiment 1. For this reason, according to this embodiment, compared with the conventional constitution, it is possible to suppress an occurrence of the darkness non-uniformity with respect to the ejection outlet array direction.

Third Embodiment

Figure 6B:
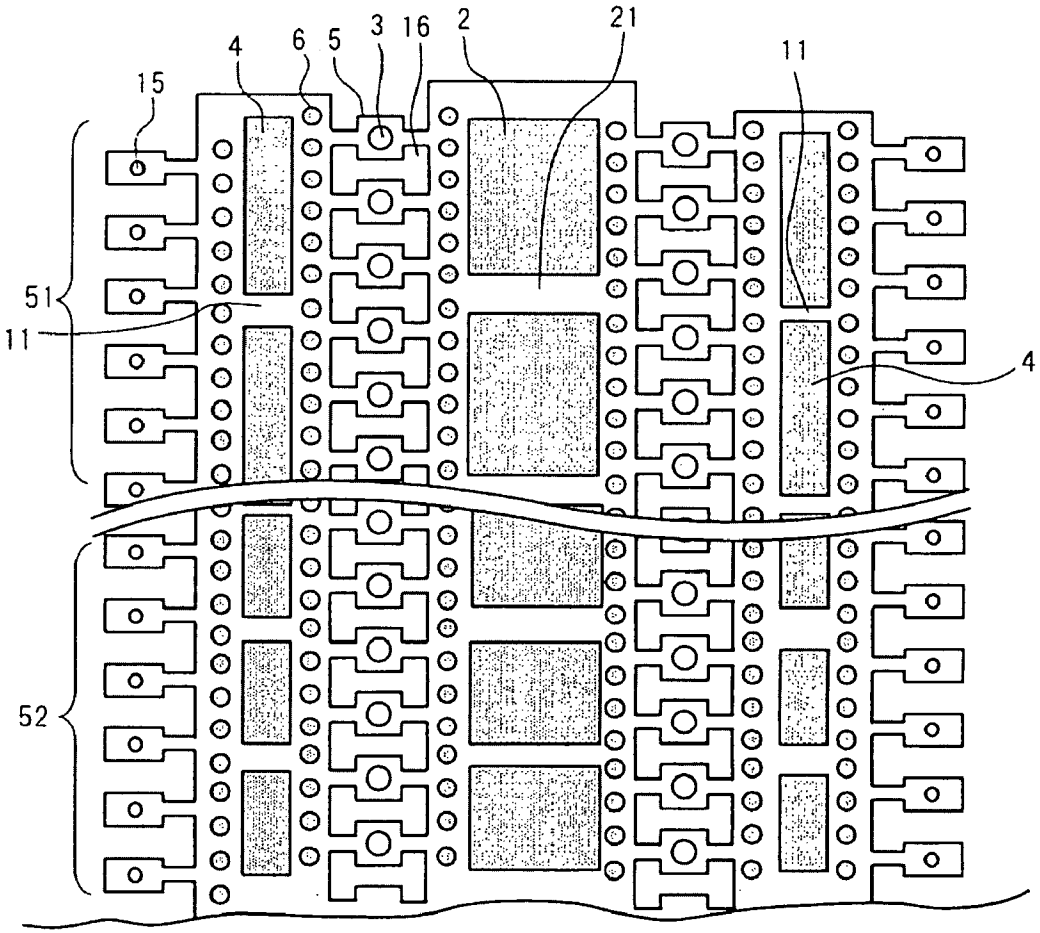
FIGS. 6A and 6B are schematic views for illustrating a recording head in Third Embodiment.
Figure 6A:
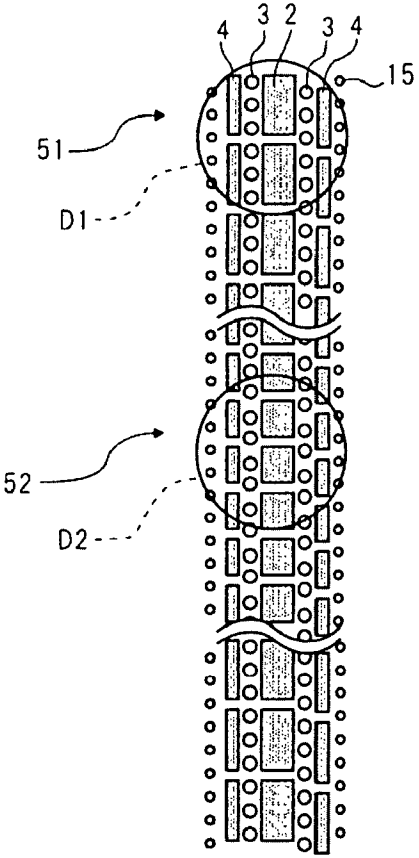

Third Embodiment of the present invention will be described with reference to FIGS. 6A and 6B by principally explaining a difference in constitution from Second Embodiment. FIGS. 6A and 6B are schematic views of a recording head in this embodiment, wherein FIG. 6B is an enlarged view of portions D1 and D2. A basic constitution of this embodiment is similar to that of Second Embodiment and therefore members or portions for the constitution of this embodiment are represented by reference numerals identical to those in Second Embodiment and are omitted from detailed description.

The independent ink supply ports 4 and the common ink supply ports 2 are disposed in the rectangular opening shapes and at the arrangement intervals, as shown in FIGS. 6A and 6B, similarly as in the constitution of Second Embodiment. In this embodiment, a first ejection outlet array consisting of the ejection outlets 3 disposed between the plurality of common ink supply ports 2 and the plurality of independent ink supply ports 4 and a second ejection outlet array consisting of ejection outlets 15 disposed on an opposite side from the first ejection outlet array with respect to the plurality of independent ink supply ports 4 are provided. These first and second ejection outlet arrays are arranged in parallel to each other.

That is, a second heater array provided correspondingly to the second ejection outlet array is arranged, at each of lateral end portions of the recording head substrate 10 outside the independent ink supply ports 4, along a longitudinal direction of the recording head substrate 10 so as to provide a pitch corresponding to 600 dpi to the heaters constituting the second heater array. The flow passage constituent member 16 is provided so that the ink is also ejectable from the second heater array and is molded integrally with the ejection outlet plate 17 disposed on the flow passage constituent member 16. The flow passage constituent member 16 is provided with ink flow passages for guiding the ink, supplied from the independent ink supply ports 4, to the bubble generation chambers 5 on the heaters 1 of the second heater array. Further, the ejection outlet plate 17 is provided with ink ejection nozzles for establishing communication of the bubble generation chambers 5, separated by the flow passage constituent member 16, with the outside of the recording head. Openings of ends of the ink ejection nozzles exposed at the surface of the ejection outlet plate 17 constitute the second ejection outlets 15.

Also in the constitution of this embodiment, similarly as in First Embodiment, thermal (heat) resistance in an area of the ejection outlet array central portion which is originally liable to be placed in a high temperature state is small and that in an area of the ejection outlet array both end portions which is relatively less liable to be placed in the high temperature state is large. For this reason, the temperature difference between at the ejection outlet array central portion and at the ejection outlet array both end portions can be suppressed at a low level, so that uniformity of the temperature distribution with respect to the ejection outlet array direction can be improved. Therefore, according to this embodiment, compared with the conventional constitution, it is possible to suppress the occurrence of the darkness non-uniformity with respect to the ejection outlet array direction.

The liquid ejection recording head of the present invention is suitably used for a general-purpose printing device, a copying machine, a facsimile machine including a communication system, a device such as a word processor including a printer portion, and multifunction recording devices having functions of these devices. The liquid ejection recording head of the present invention is mountable to a printer, a copying machine, a facsimile machine provided with a communication system, a device such as a word processor provided with a printer portion, and industrial recording devices compositively combined with various processing devices. By using this liquid ejection recording head, it is possible to carry out recording on various recording media (materials) such as paper, thread, fiber or fabric, leather, metal, plastic, glass, wood, and ceramics. The term "recording" referred to in the above-described embodiments means not only that a significant image such as a character image or a graphical image is provided to the recording material but also that an insignificant image such as a pattern image is provided to the recording material.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 041432/2008 filed Feb. 22, 2008, which is hereby incorporated by reference herein.

What is claimed is:

1. A liquid ejection recording head comprising:

an element substrate provided with a plurality of ejection energy generating elements for generating energy for ejecting liquid;

an ejection outlet array comprising a plurality of ejection outlets for ejecting the liquid; and bubble generation chambers for generating bubbles by the ejection energy generating elements, wherein said element substrate comprises a first liquid supply port provided, by being penetrating through said element substrate, along an arrangement direction of the ejection outlets and comprises a plurality of second liquid supply ports disposed between a lateral end of said element substrate and said bubble generation chambers, wherein each of said bubble generation chambers communicates with the first liquid supply port through a first liquid supply passage and communicates with the second liquid supply ports through a second liquid supply passage, wherein said element substrate has a thermal resistance against heat flowing from the ejection energy generating elements along a direction which is perpendicular to an ejection outlet array direction and which is parallel to a surface of said element substrate on which the ejection energy generating elements are formed, wherein the thermal resistance, per unit length with respect to the ejection outlet array direction, at both end portions of said ejection outlet array is greater than that at a central portion of said ejection outlet array, and wherein the first liquid supply port is divided into a plurality of liquid supply port portions by a bridging portion along the ejection outlet array direction.

2. A head according to claim 1, wherein the first liquid flow passage and the second liquid flow passage are formed so as to communicate with one of said bubble generation chambers from different directions.

3. A head according to claim 1, wherein the second liquid supply ports have openings different in shape at an ejection outlet central portion and at an ejection outlet end portion.

4. A head according to claim 1, wherein the second liquid supply ports are disposed at an interval that differs at an ejection outlet central portion and at an ejection outlet end portion.

5. A head according to claim 1, wherein said ejection outlet array comprises a first ejection outlet array portion disposed between the first liquid supply port and the second liquid supply ports and comprises a second ejection outlet array portion disposed on an opposite side from the first ejection outlet array portion with respect to the second liquid supply ports.

6. A liquid ejection recording head comprising:

an element substrate provided with a plurality of ejection energy generating elements for generating energy for ejecting liquid;

an ejection outlet array comprising a plurality of ejection outlets for ejecting the liquid; and bubble generation chambers for generating bubbles by the ejection energy generating elements, wherein said element substrate comprises a first liquid supply port array formed along an arrangement direction of the ejection outlets and comprises a second liquid supply port array formed along the arrangement direction of the ejection outlets, wherein each of said bubble generation chambers communicates with the first liquid supply port array through a first liquid supply passage and communicates with the second liquid supply port array through a second liquid supply passage, wherein said element substrate has a thermal resistance against heat flowing from the ejection energy generating elements along a direction which is perpendicular to an ejection outlet array direction and which is parallel to a surface of said element substrate on which the ejection energy generating elements are formed, and wherein the thermal resistance, per unit length with respect to the ejection outlet array direction, at both end portions of said ejection outlet array is larger than that at a central portion of said ejection outlet array.

7. A liquid ejection recording head comprising:

an element substrate provided with a plurality of ejection energy generating elements for generating energy for ejecting liquid;

an ejection outlet array comprising a plurality of ejection outlets for ejecting the liquid; and chambers for generating bubbles by the ejection energy generating elements, wherein said element substrate comprises a first liquid supply port array formed along an arrangement direction of the ejection outlets and comprises a second liquid supply port array formed along the arrangement direction of the ejection outlets, wherein said chambers communicate with the first liquid supply port array through a first liquid supply passage and communicate with the second liquid supply port array through a second liquid supply passage, wherein said element substrate has a thermal resistance against heat flowing from the ejection energy generating elements along a direction which is perpendicular to the arrangement direction of the ejection outlets and which is parallel to a surface of said element substrate on which the ejection energy generating elements are formed, and wherein an average of the thermal resistance, with respect to the arrangement direction of the ejection outlets, at both end portions of said element substrate is greater than that at a central portion of said element substrate.

8. A head according to claim 7, wherein the second liquid supply port array has supply ports having openings different in shape at an ejection outlet central portion and at an ejection outlet end portion.

9. A head according to claim 7, wherein the second liquid supply port array has supply ports that are disposed at an interval that differs at an ejection outlet central portion and at an ejection outlet end portion.

10. A head according to claim 7, wherein said ejection outlet array comprises a first ejection outlet array portion disposed between the first liquid supply port array and the second liquid supply port array and comprises a second ejection outlet array portion disposed on an opposite side from the first ejection outlet array portion with respect to the second liquid supply port array.

* * * * *